US006324369B1

(12) United States Patent
Yamaguchi et al.

(10) Patent No.: US 6,324,369 B1
(45) Date of Patent: Nov. 27, 2001

(54) DEVELOPING APPARATUS, PROCESS CARTRIDGE AND IMAGE FORMING APPARATUS

(75) Inventors: Seiji Yamaguchi, Numazu; Masahide Kinoshita, Shizuoka-ken, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/537,875

(22) Filed: Mar. 29, 2000

(30) Foreign Application Priority Data

Apr. 2, 1999 (JP) ..... 11-095904
Mar. 16, 2000 (JP) ..... 12-073776

(51) Int. Cl.[7] ..... G03G 15/08

(52) U.S. Cl. ..... 399/254; 399/119; 399/256; 399/263

(58) Field of Search ..... 399/254–256, 399/263, 272, 281, 119, 120

(56) References Cited

U.S. PATENT DOCUMENTS 4,864,349 * 9/1989 Ito ..... 355/253
4,873,551 10/1989 Tajima et al. ..... 355/251
4,887,131 12/1989 Kinoshita et al. ..... 355/253
5,881,345 * 3/1999 Yamane et al. ..... 399/255
5,893,013 4/1999 Kinoshita et al. ..... 399/284
5,895,151 4/1999 Kinoshita et al. ..... 399/284
5,943,537 * 8/1999 Ahn ..... 399/254
6,026,265 2/2000 Kinoshita et al. ..... 399/281
6,035,168 * 3/2000 Masuda et al. ..... 399/254
6,058,284 5/2000 Okano et al. ..... 399/284

* cited by examiner

*Primary Examiner*—Sandra Brase
*Assistant Examiner*—Hoang Ngo
(74) *Attorney, Agent, or Firm*—Fitzpatrick, Cella, Harper & Scinto

(57) ABSTRACT

A developing apparatus has a developer container for containing developer, a developer bearing member for bearing the developer within the developer container and for carrying the developer to a position opposed to an image bearing member. A first agitating member agitates the developer within the developer container, and a second agitating member agitates the developer within the developer container. The second agitating member is positioned farther than the first agitating member with respect to the image bearing member and an uppermost part of the second agitating member is higher than an uppermost part of the first agitating member.

21 Claims, 4 Drawing Sheets

DEVELOPING APPARATUS, PROCESS CARTRIDGE AND IMAGE FORMING APPARATUS

BACKGROUND OF THE INVENTION

1. Field of the Invention

The present invention relates to an image forming apparatus of electrophotographic type or electrostatic recording type such as a copying machine, a page printer and the like, and more particularly, it relates to a developing apparatus, and a process cartridge and an image forming apparatus which have such a developing apparatus.

2. Related Background Art

In such developing apparatus, since charging ability for toner is very good in an electrophotographic process, a developing apparatus using two component developer developing agent including toner and carrier (referred to as "two-component developing apparatus" hereinafter) has widely been used.

FIG. 5 is a sectional view showing a conventional two-component developing apparatus.

As shown in FIG. 5, the two-component developing apparatus has a developer container 110 containing two-component developer, and a developing sleeve 102 as a developer bearing member.

The developing sleeve 102 is a rotatable hollow metallic sleeve in which a magnet roller (magnetic field generating means) 103 is fixed and which serves to bear the developer in the developer container 110.

An A screw (first agitating means) 105 having an axis substantially parallel with an axial direction of the developing sleeve 102 is disposed within the developing container 110 and serves to convey and agitate the developer in the developer container 110 in a direction shown by the arrow in FIG. 8.

Further, a B screw (second agitating member) 106 is disposed at an opposite side of the developing sleeve 102 with respect of the A screw 105.

FIG. 8 is a top view of the two-component developing apparatus shown in FIG. 5.

As shown in FIG. 8, the A screw 105 and B screw 106 are arranged so that their axes become substantially parallel with each other, and the developer container 110 is partitioned by an inner wall (partition member) 107 for dividing the interior of the developer container 110 into two chambers, which inner wall is provided at its both ends (in the axial direction of the developing sleeve 102) with openings for permitting the developer to move between the A screw 105 and the B screw 106.

Further, since the A screw 105 and B screw 106 convey the developer in opposite directions, a circulating path for circulating developer without discontinuity is defined within the developer container 110.

The developer container 110 is provided at its upper part with a replenishing port 108 for replenishing the developer in the developer container 110.

When toner (developer) density in the developer is decreased as a result that the toner is consumed during image formation, a proper amount of toner is replenished in the developer container 110 through the replenishing port 108 by means of a toner replenishing mechanism 109 so that the toner density of the developer is always maintained to a constant value.

However, in such a developing apparatus, it is very difficult to design the developing apparatus so that the developer is well circulated, and, thus, it is desirable that the two-component developing apparatus satisfies the following three conditions or requirements.

First, it is preferable that a surface of the developer within the developer container near the A screw (referred to as "agent surface" hereinafter) is above an uppermost part of the A screw.

The reason is that, since the A screw 105 is positioned near the developing sleeve, as shown in FIG. 6, if the agent surface is lowered below the uppermost part of the A screw, the developer supplied to the developing sleeve between uneven (i.e., increased or decreased) in dependence upon a pitch of vanes of the A screw, with the result that density unevenness of an image may occur due to the pitch of the screw (referred to as "screw pitch unevenness").

So long as the agent surface near the A screw in the developer container is positioned above the uppermost part of the A screw, since the developer is supplied to the developing sleeve relatively uniformly, the screw pitch unevenness is hard to generate.

Second, it is preferable that an agent surface near the B screw in the developer container is below an uppermost part of the B screw.

The reason is that, the side of the B screw in the developer container has a purpose for agitating the developer in the developer container, and, thus, if the agent surface is increased above the uppermost part of the B screw, the agent above the B screw is hard to be agitated.

Particularly, as shown in FIG. 7, if the toner is replenished when the agent surface near the B screw is above the uppermost part of the B screw, the toner having specific weight smaller than the developer may be floating on the agent surface.

In such a case, the toner is hard to be mixed with the developer, with the result that non-charged toner is supplied to the developing sleeve, thereby causing fog or poor density.

However, in the case where the agent surface near the B screw within the developer container is below the uppermost part of the B screw, even when the toner is replenished, the toner is semiforcibly entered into the developer by rotation of the B screw to be agitated adequately, thereby preventing the fog and the poor density.

Third, the agent surfaces near the B screw and the A screw within the developer container may be horizontal at their screw areas.

The reason is that, if the agent surface near the A screw within the developer container is inclined in a longitudinal direction, the amount of the developer supplied to the developing sleeve becomes uneven in the longitudinal direction, with the result that difference in density may occur along the longitudinal direction.

On the other hand, if the agent surface near the B screw within the developer container is inclined in the longitudinal direction, the charging ability due to agitation may be reduced.

In order to satisfy these requirements, it is necessary to perform delicate adjustments of the shape of the developer container, the amount of the developer, the pitch between the vanes of the screw, rotational speeds of the screws and the like.

However, if the amount of the developer container is decreased, as shown in FIG. 6, the uppermost part of the A screw will be come out from the agent surface; whereas, if the amount of the developer is increased, as shown in FIG. 7, the B screw will be lowered below the agent surface.

Further, in order to satisfy the first and second requirements, if a conveying speed of the B screw is merely increased, the upstream side (in the conveying direction) of the agent surface of the A screw will be higher than the downstream side thereof, with the result that the third requirement cannot be satisfied. Consequently, the difference in density occurs in the longitudinal direction. Thus, very delicate adjustment is requested to make the design of the developing apparatus very difficult.

SUMMARY OF THE INVENTION

An object of the present invention is to provide a developing device, a process cartridge having such a developing apparatus, and an image forming apparatus having such a developing apparatus, which can maintain high image quality.

Another object of the present invention is to provide a developing device, a process cartridge having such a developing apparatus, and an image forming apparatus having such a developing apparatus, in which design can easily be attained, developer can stably be circulated in a developer contained by first and second agitating means, and density unevenness, fog and poor density can be prevented.

A further object of the present invention is to provide a developing apparatus comprising a developer container for containing developer, a developer bearing member for bearing the developer within the developer container and for conveying the developer to a position opposed to an image bearing member, a first agitating member for agitating the developer within the developer container, a second agitating member for agitating the developer within the developer container, and wherein the second agitating member is positioned farther than the first agitating member with respect to the image bearing member and an uppermost part of the second agitating member is higher than an uppermost part of the first agitating member.

A still further object of the present invention is to provide a process cartridge comprising an image bearing member for bearing a latent image, a developer container containing developer, a developer bearing member for bearing the developer within the developer container and for carrying the developer to a position opposed to an image bearing member, a first agitating member for agitating the developer within the developer container, a second agitating member for agitating the developer within the developer container, and wherein the second agitating member is positioned farther than the first agitating member with respect to the image bearing member and an uppermost part of the second agitating member is higher than an uppermost part of the first agitating member.

A further object of the present invention is to provide an image forming apparatus comprising an image bearing member for bearing a latent image, a developer container for containing developer, a developer bearing member for bearing the developer within the developer container and for carrying the developer to a position opposed to an image bearing member, a first agitating member for agitating the developer within the developer container, a second agitating member for agitating the developer within the developer container, and wherein the second agitating member is positioned farther than the first agitating member with respect to the image bearing member and an uppermost part of the second agitating member is higher than an uppermost part of the first agitating member.

The other objects and features of the present invention will be apparent from the following detailed explanation referring to the accompanying drawings.

DETAILED DESCRIPTION OF THE PREFERRED EMBODIMENTS

The present invention will now be explained in connection with embodiments thereof with reference to the accompanying drawings.

(First embodiment)

First of all, a first embodiment of the present invention will be explained.

Figure 1:
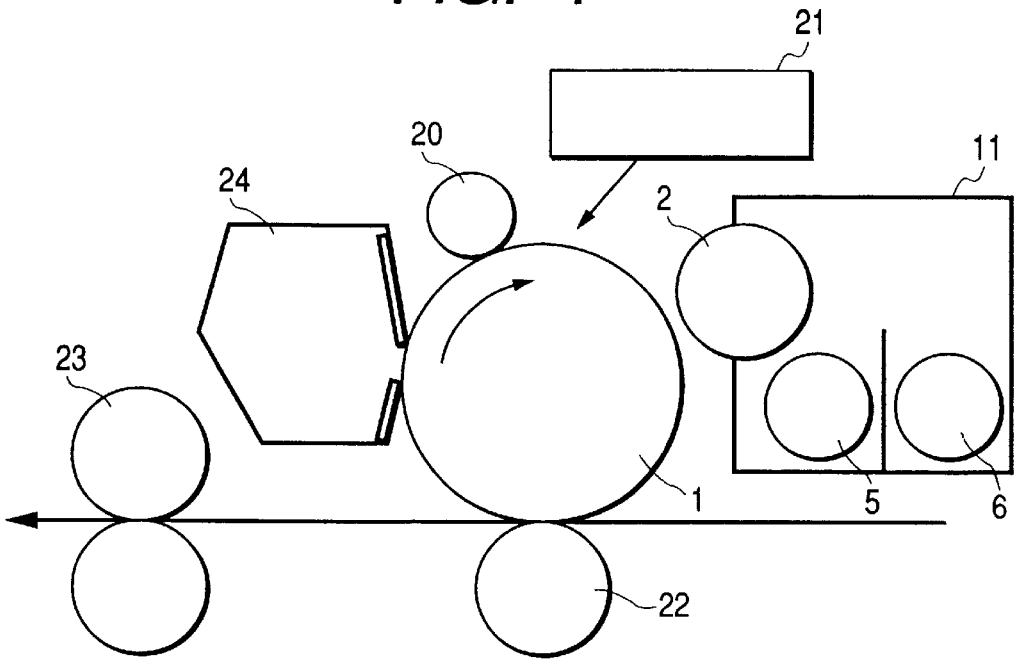
FIG. 1 is a schematic sectional view of an image forming apparatus according to a first embodiment of the present invention.

FIG. 1 is an explanatory view showing an example of an image forming apparatus of electrophotographic type having a developing apparatus according to the present invention.

As shown in FIG. 1, the image forming apparatus comprises a rotatable drum-shaped photosensitive drum (latent image bearing member) 1, a developing apparatus 11, an exposure device 21 for forming an electrostatic latent image corresponding to image information on an outer peripheral surface of the photosensitive drum 1 by performing an exposure process in response to the image information from an image information providing device (not shown), a transfer device 22 for transferring an image onto a transfer material (recording medium), and a fixing device 23 for fixing the image to the transfer material by applying heat and pressure to the transfer material to which the image was transferred.

In such an image forming apparatus, first of all, the outer peripheral surface of the photosensitive drum 1 charged to predetermined potential by a charging device 20 is exposed by the exposure device 21, thereby forming the electrostatic latent image corresponding to the image information presented from the image information providing device to the image forming apparatus on the outer peripheral surface of the photosensitive drum 1.

Then, the electrostatic latent image formed on the outer peripheral surface of the photosensitive drum 1 is visualized as a visible image by applying developer from the developing apparatus 11 to the latent image.

On the other hand, the transfer material on which the image corresponding to the image information is to be recorded is fed between the photosensitive drum 1 and the transfer device 22 at a predetermined timing.

As a result, the visualized image formed and borne on the outer peripheral surface of the photosensitive drum 1 is transferred onto the transfer material reached between the photosensitive drum 1 and the transfer device under the electrical action of the transfer device 22.

Then, the transfer material on which visualized image (visualized image in non-fixed condition is referred to as "unfixed image" hereinafter) was borne in non-fixed condition is conveyed to the fixing device 23, where heat is supplied to the unfixed image and pressure is applied to the unfixed image to fuse and fix the unfixed image to the transfer material. In this way, the image corresponding to the image information is recorded on the transfer material. Thereafter, the transfer material on which the image was recorded is discharged onto a discharge tray (not shown) on a main body of the image forming apparatus.

Figure 2:
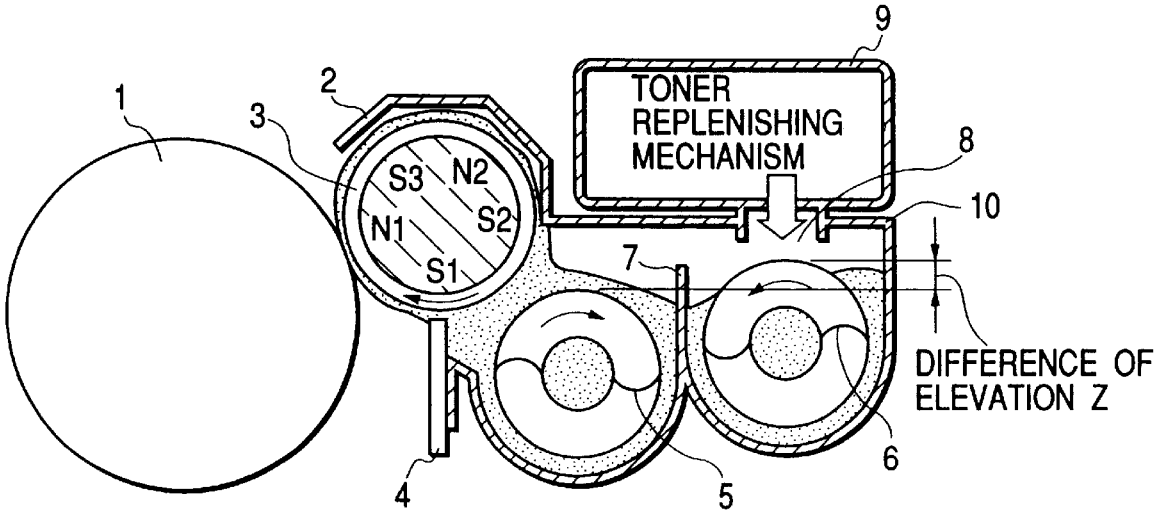
FIG. 2 is a schematic sectional view showing of a developing apparatus included in the image forming apparatus of FIG. 1.
Figure 3:
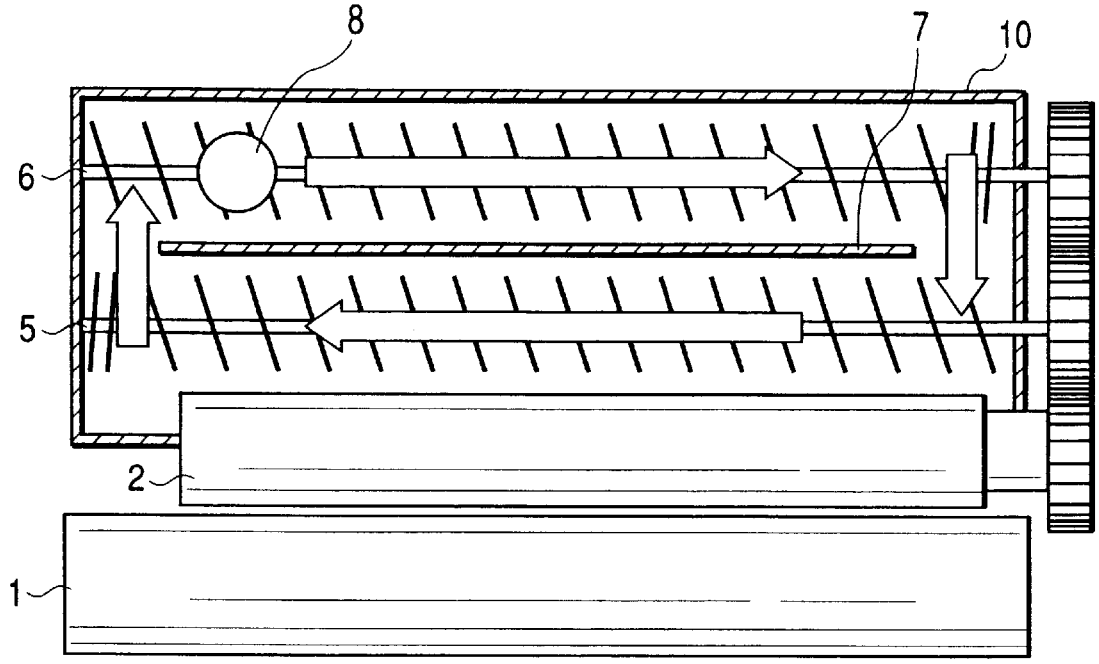
FIG. 3 is a top view of the developing apparatus of FIG. 2.

FIG. 2 is a sectional view of the developing apparatus 11 according to the illustrated embodiment.

As shown in FIG. 2, the developing apparatus 11 comprises a developer container 10 containing developer (two-component developer) including toner and carrier, a developing sleeve (developer bearing member) 2, and A screw (first agitating means) 5, a B screw (second agitating means) 6, and an inner wall (partition member) 7.

The developing sleeve 2 is a rotatable aluminum sleeve having a diameter of 16 mm a surface of which is blast-treated to about Rz 5 $\mu$m.

A magnet roller 3 is fixed within the developing sleeve 2 so that the developer can be borne on the surface of the developing sleeve 2. The magnet roller 3 has five magnetic poles N1, S1, S2, N2 and S3. Magnetic flux density of the N1 magnetic pole is 850 to 1100 gauss (0.085 to 0.11 T(tesla)) (preferably, 900 to 1000 gauss (0.09 to 0.1 T)), magnetic flux density of the S1 magnetic pole is 500 to 700 gauss (0.05 to 0.07 T) (preferably, 600 to 650 gauss (0.06 to 0.065 T)), magnetic flux density of the S2 magnetic pole is 400 to 600 gauss (0.04 to 0.06 T) (preferably 450 to 550 gauss (0.045 to 0.055 T)), magnetic flux density of the N2 magnetic pole is 500 to 700 gauss (0.05 to 0.07 T) (preferably, 550 to 650 gauss (0.055 to 0.065 T)), and magnetic flux density of the S3 magnetic pole is 450 to 600 gauss (0.045 to 0.06 T) (preferably, 500 to 550 gauss (0.05 to 0.055 T)).

A developer regulating member 4 is disposed in the vicinity of the developing sleeve 2 so that a thin developer layer is formed on the developing sleeve 2 and is supplied to a developing area between the developing sleeve 2 and the photosensitive drum 1.

The rotatable A screw 5 having a diameter of 14 mm and having an axis parallel with an axial direction of the developing sleeve 2 is arranged below and in the vicinity of the developing sleeve 2.

The A screw 5 serves to agitate the developer while carrying the developer toward the axial direction to bear the developer on the developing sleeve 2, thereby supplying the developer to the developing sleeve 2 and carrying the used developer.

The inner wall 7 is disposed at an opposite side of the A screw 5 with respect to the developing sleeve 2 and extends toward the axial direction. The inner wall is provided at its both ends with openings and divides the interior of the developer container 10 into two chambers.

The rotatable B screw 6 having a diameter of 14 mm and having an axis parallel with the axial direction of the developing sleeve 2 is arranged at an opposite side of the inner wall 7 with respect to the developing sleeve 2.

Further, since the A screw 5 and the B screw 6 carry the developer toward opposite directions, a circulating path for circulating the developer without discontinuity is formed within the developer container 10.

The developer container 10 is provide with a replenishing opening 8 disposed above the B screw 6 and adapted to replenish the toner into the developer container 10.

When the toner is used in the image formation to decrease the toner density, a proper amount of toner is replenished into the developer container 10 through the replenishing opening 8 by the toner replenishing mechanism 9, thereby always keeping the toner density of the developer.

The illustrated embodiment is characterized in that the uppermost part of the B screw 6 is positioned at the position higher than the uppermost part of the A screw, and a height difference (difference of elevation) Z between the uppermost part of the A screw and the uppermost part of the B screw (distance 6 between the uppermost part of the A screw and the uppermost part of the B screw) is selected to 6 mm.

With this arrangement, even if the agent surface is horizontal in the condition that the developer is contained in the developer container 10, since the A screw 5 and the B screw 6 are arranged with the height difference therebetween, as shown in FIG. 2, there is maintain a condition that the agent surface near the A screw 5 with respect to the inner wall 7 (referred to as "agent surface at the A screw 5 side" hereinafter) within the developer container 10 is above the uppermost part of the A screw 5 and the agent surface near the B screw 6 with respect to the inner wall 7 (referred to as "agent surface at the B screw 6 side" hereinafter) within the developer container 10 is below the uppermost part of the B screw 6.

Thus, the A screw 5 is always located below the agent surface to prevent occurrence of the screw pitch unevenness.

Further, since the B screw 6 is always protruded from the agent surface, the replenished toner does not remain on the agent surface but is agitated together with the developer, with the result that the toner is charged effectively.

Further, even if the heights of the agent surfaces near the A screw 5 and the B screw 6 are changed more or less, since the carrying amount of developer is automatically changed by the amount of the developer associated with the B screw 6, the agent surface are always kept to a steady state condition, with the result that the apparatus is always maintained to a stable condition.

Explaining concretely, for example, if the agent surface at the B screw 6 side is lifted, since the developer carrying amount of the B screw 6 is increased to carry a larger amount of developer to the A screw 5, the agent surface is gradually lowered to attain the steady state condition eventually.

To the contrary, if the agent surface at the B screw 6 side is lowered, since the developer carrying amount of the B screw 6 is decreased, so that a larger amount of toner is carried from the A screw 5, thereby attaining the steady state condition eventually.

Incidentally, in the illustrated embodiment, while an example that the B screw having the diameter of 14 mm is used and the height difference Z is selected to 5 mm was explained, the present invention is not limited to such an example.

The inventors conducted tests to seek an optimum value of the height difference and it was found that the value is preferably not less than 10% and not more than 50% of the diameter of the B screw 6.

The reason is that, if the height difference Z is equal to or larger than 10% of the diameter of the B screw 6, the effect of the height difference is hard to be achieved and that, if the height difference Z is smaller than 60% of the diameter of the B screw 6, the amount of toner associated with the B screw is apt to be smaller, with the result that the agitating ability is hard to be achieved.

The diameters of the A screw and B screw are not limited to the diameters recited in the present embodiment.

Thus, according to the illustrated embodiment, with a simple construction, the developer within the developer container 10 can stably be circulated by the A screw 5 and the B screw 6, and the density unevenness, fog and poor density can be prevented.

(Second embodiment)

Next, a second embodiment of the present invention will be explained. Incidentally, the same elements as those in the first embodiment are designated by the same reference numerals and explanation thereof will be omitted.

In the second embodiment, the developing apparatus 11 according to the first embodiment is integrally constructed with the photosensitive drum 1, the charging device as a process means and the cleaning device to be a process cartridge which is detachably attachable to a main body of the image forming apparatus.

Figure 4:
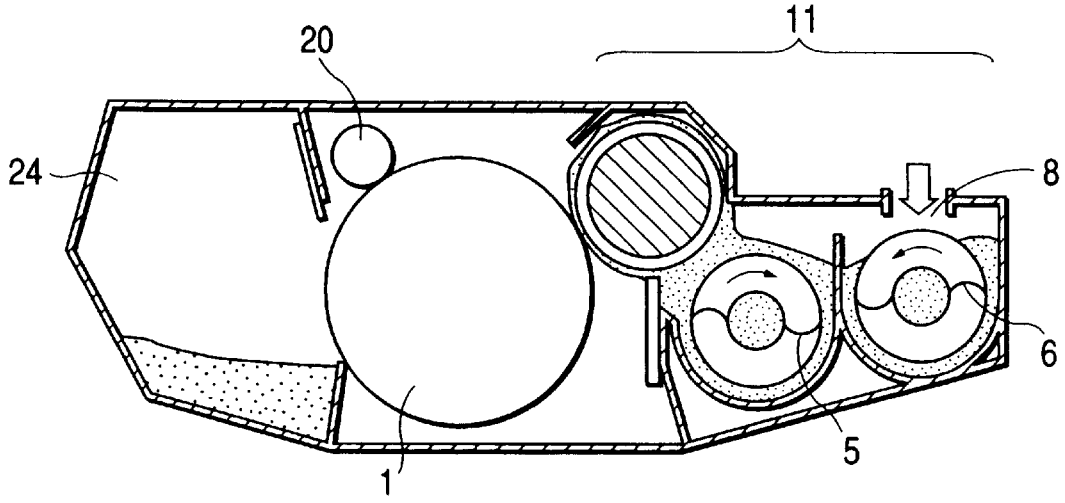
FIG. 4 is a schematic sectional view of a process cartridge according to a second embodiment of the present invention.
Figure 5:
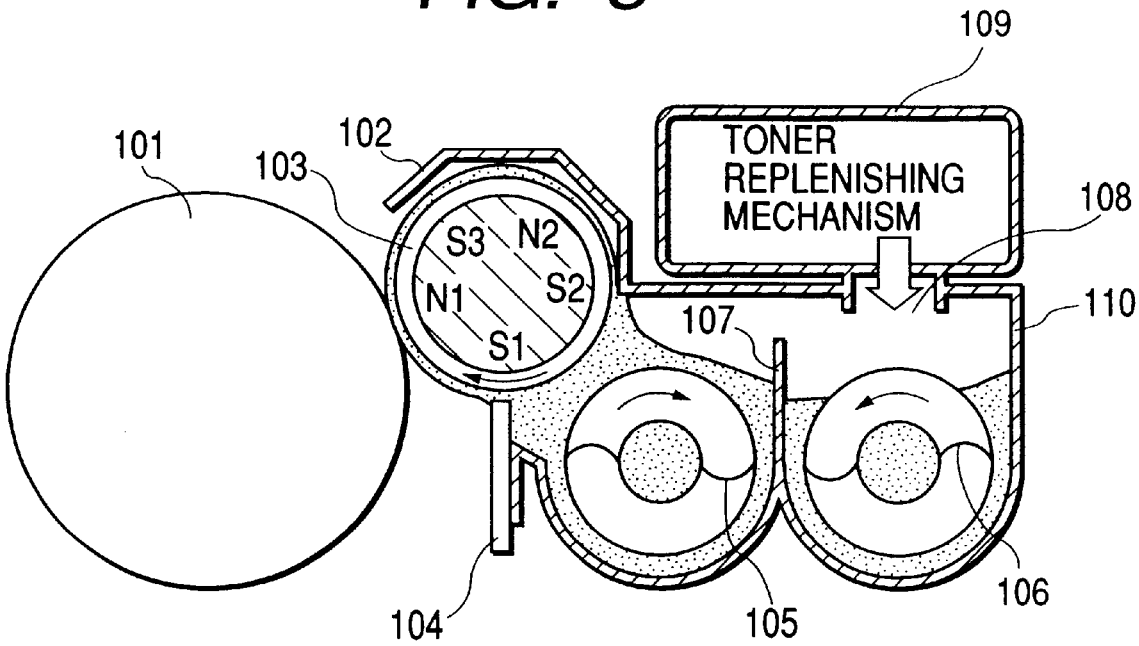
FIG. 5 is a schematic sectional view of a conventional developing apparatus.
Figure 6:
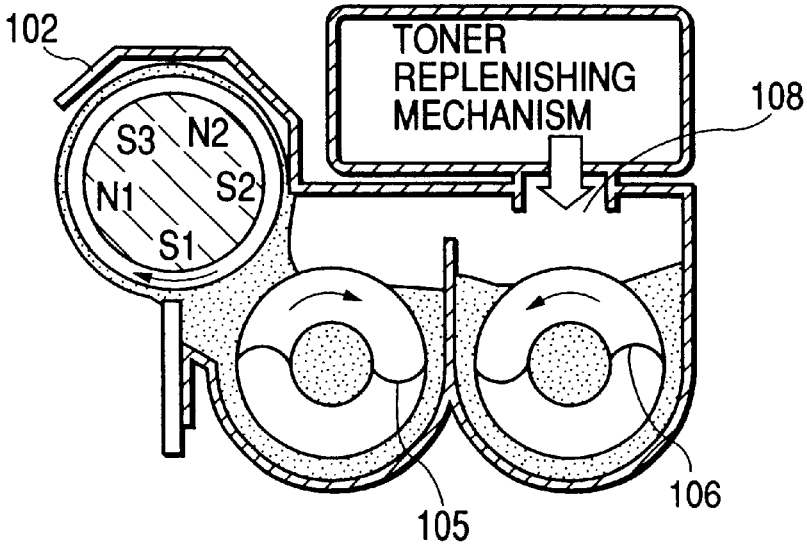
FIG. 6 is a view for explaining a condition that a developer surface near first agitating means of the developing Apparatus of FIG. 5 is improper.
Figure 7:
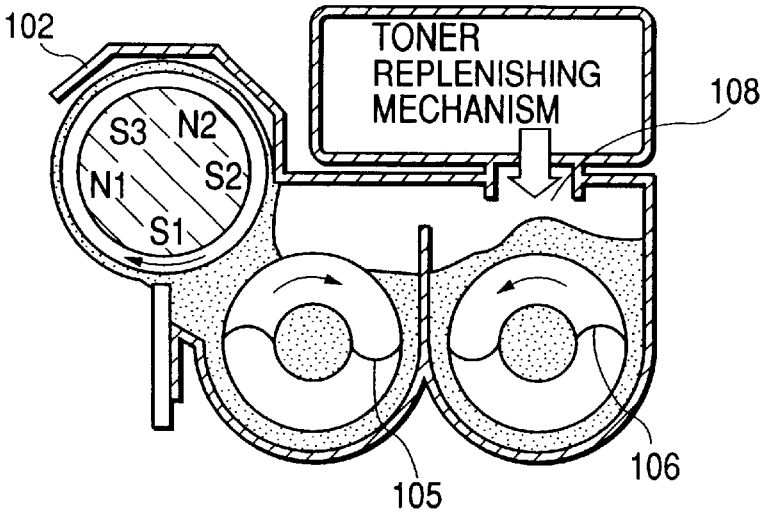
FIG. 7 is a view for explaining a condition that a developer surface near second agitating means of the developing apparatus of FIG. 5 is improper.
Figure 8:
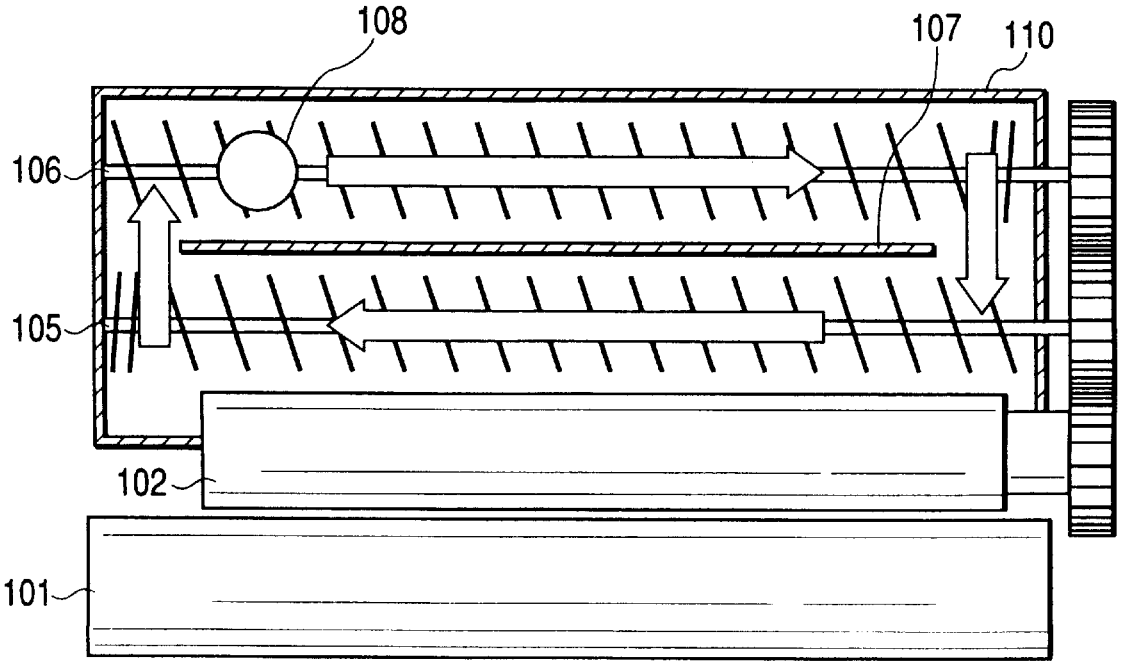
FIG. 8 is a top view of the developing apparatus of FIG. 5.

FIG. 4 is a sectional view of the process cartridge according to the second embodiment.

The process cartridge includes the photosensitive drum 1, charging device 20, developing apparatus 11 and cleaning device 24.

With the arrangement as mentioned above, in addition to the achievement of the effect of the first embodiment, such constructural elements can easily be exchanged.

Accordingly, maintenance ability of the image forming apparatus is enhanced considerably.

Further, only by exchanging the process cartridge, since important electrophotographic constructural elements can be exchanged, high image quality can always be maintained.

Thus, according to the second embodiment, with a simple construction, the developer within the developer container 10 can stably be circulated by the A screw 5 and the B screw 6, and the density unevenness, fog and poor density can be prevented.

As mentioned above, according to the present invention, design can be effected easily and the developer within the developer container can stably be circulated by the first and second agitating means, and the density unevenness, fog and poor density can be prevented.

What is claimed is:

1. A developing apparatus comprising:

a developer container for containing developer;

a developer bearing member for bearing the developer within said developer container and for carrying the developer to a position opposed to an image bearing member;

a first agitating member for agitating the developer within said developer container;

a second agitating member for agitating the developer within said developer container, wherein said second agitating member is positioned farther than said first agitating member with respect to said image bearing member and an uppermost part of said second agitating member is higher than an uppermost part of said first agitating member, and wherein a height difference between said uppermost part of said first agitating member and said uppermost part of said second agitating member is not less than 10% and not more than 50% of an agitating diameter of said second agitating member.

2. A developing apparatus according to claim 1, wherein said uppermost part of said first agitating member is positioned below an upper surface of the developer within said developer container.

3. A developing apparatus according to claim 2, wherein said uppermost part of said second agitating member is positioned above the upper surface of the developer within said developer container.

4. A developing apparatus according to claim 1, further comprising a partition member disposed within said developer container, wherein said partition member partitions interior of said developer container so that openings are formed at at least both ends thereof.

5. A developing apparatus according to claim 4, wherein said first agitating member is disposed at an area partitioned by said partition member and near said image bearing member, and said second agitating member is disposed at an area partitioned by said partition member and remote from said image bearing member.

6. A developing apparatus according to claim 4, wherein, when the developer is replenished into said developer container, the developer is replenished into the area partitioned by said partition member and remote from said image bearing member.

7. A developing apparatus according to claim 1, wherein the developer includes toner and carrier.

8. A process cartridge comprising:

an image bearing member for bearing a latent image;

a developer container containing developer;

a developer bearing member for bearing the developer within said developer container and for carrying the developer to a position opposed to an image bearing member;

a first agitating member for agitating the developer within said developer container; and a second agitating member for agitating the developer within said developer container, wherein said second agitating member is positioned farther said first agitating member with respect to said image bearing member and an uppermost part of said second agitating member is higher than an uppermost part of said first agitating member, and wherein a height difference between said uppermost part of said first agitating member and said uppermost part of said second agitating member is not less than 10% and not more than 50% of an agitating diameter of said second agitating member.

9. An image forming apparatus comprising:

an image bearing member for bearing a latent image;

a developer container for containing developer;

a developer bearing member for bearing the developer within said developer container and for carrying the developer to a position opposed to an image bearing member;

a first agitating member for agitating the developer within said developer container; and a second agitating member for agitating the developer within said developer container, wherein said second agitating member is positioned farther than said first agitating member with respect to said image bearing member and an uppermost part of said second agitating member is higher than an uppermost part of said first agitating member, and wherein a height difference between said uppermost part of said first agitating member and said uppermost part of said second agitating member is not less than 10% and not more than 50% of an agitating diameter of said second agitating member.

10. A developing apparatus comprising:

a developer container for containing developer;

a developer bearing member for bearing and carrying the developer within said developer container to develop a latent image formed on an image bearing member;

a first agitating member for agitating and carrying the developer within said developer container to said developer bearing member; and a second agitating member for agitating and carrying the developer within said developer container to said first agitating member, wherein, in developing, a whole of an agitating portion of said first agitating member is covered by the developer and a part of an agitating portion of said second agitating member is exposed from the developer.

11. A developing apparatus according to claim 10, wherein an uppermost part of the agitating portion of said second agitating member is provided above an uppermost part of the agitating portion of said first agitating member.

12. A developing apparatus according to claim 11, wherein a height difference between said uppermost part of said first agitating member and said uppermost part of said second agitating member is not less than 10% and not more than 50% of an agitating diameter of said second agitating member.

13. A developing apparatus according to claim 10, wherein said developer container includes a partition portion for partitioning into a first chamber in which said first agitating member is provided and a second chamber in which said second agitating member is provided, and said partition portion is provided with an opening portion for opening said first chamber and said second chamber.

14. A developing apparatus according to claim 13, wherein the developer is replenished into said second chamber.

15. A developing apparatus according to claim 10, wherein the developer has a toner and a carrier.

16. A process cartridge detachably attachable to an image forming apparatus, comprising:

an image bearing member;

a developer container for containing developer;

a developer bearing member for bearing and carrying the developer within said developer container to develop a latent image formed on said image bearing member;

a first agitating member for agitating and carrying the developer within said developer container to said developer bearing member; and a second agitating member for agitating and carrying the developer within said developer container to said first agitating member, wherein, in developing, a whole of an agitating portion of said first agitating member is covered by the developer and a part of an agitating portion of said second agitating member is exposed from the developer.

17. A developing apparatus according to claim 16, wherein an uppermost part of the agitating portion of said second agitating member is provided above an uppermost part of the agitating portion of said first agitating member.

18. A developing apparatus according to claim 17, wherein a height difference between said uppermost part of said first agitating member and said uppermost part of said second agitating member is not less than 10% and not more than 50% of an agitating diameter of said second agitating member.

19. A developing apparatus according to claim 16, wherein said developer container includes a partition portion for partitioning into a first chamber in which said first agitating member is provided and a second chamber in which said second agitating member is provided, and said partition portion is provided with an opening portion for opening said first chamber and said second chamber.

20. A developing apparatus according to claim 19, wherein the developer is replenished into said second chamber.

21. A developing apparatus according to claim 16, wherein the developer has a toner and a carrier.

* * * * *

UNITED STATES PATENT AND TRADEMARK OFFICE

CERTIFICATE OF CORRECTION

PATENT NO. : 6,324,369 B1
DATED : November 27, 2001
INVENTOR(S) : Seiji Yamaguchi et al.

It is certified that error appears in the above-identified patent and that said Letters Patent is hereby corrected as shown below:

Column 2,
Line 65, "be" should be deleted.

Column 4,
Line 17, "Apparatus" should read -- apparatus --.

Column 6,
Line 20, "maintain" should read -- maintained --.

Column 10,
Lines 19, 23, 29, 36 and 39, "developing apparatus" should read -- process cartridge --.

Signed and Sealed this

Seventh Day of May 2002

*Attest:*

*Attesting Officer*

JAMES E. ROGAN
*Director of the United States Patent and Trademark Office*